US008393186B2

(12) United States Patent
Schmidt et al.

(10) Patent No.: US 8,393,186 B2
(45) Date of Patent: Mar. 12, 2013

(54) COMBINATION DISCUS LOCK ASSEMBLY AND METHODS OF USING THE SAME

(75) Inventors: Peter Schmidt, San Jose, CA (US); Kurt Kemppainen, Mound, MN (US)

(73) Assignee: Wordlock, Inc., Santa Clara, CA (US)

( * ) Notice: Subject to any disclaimer, the term of this patent is extended or adjusted under 35 U.S.C. 154(b) by 98 days.

(21) Appl. No.: 12/857,176

(22) Filed: Aug. 16, 2010

(65) Prior Publication Data

US 2011/0079055 A1 Apr. 7, 2011

Related U.S. Application Data

(60) Provisional application No. 61/249,165, filed on Oct. 6, 2009.

(51) Int. Cl.
*E05B 37/02* (2006.01)

(52) U.S. Cl. ..... 70/22; 70/25; 70/40; 70/52; 70/445

(58) Field of Classification Search ..... 70/22, 24, 70/25, 40, 48, 52, 445, 446; D8/331, 333–335, D8/339, 341

See application file for complete search history.

(56) References Cited

U.S. PATENT DOCUMENTS

| | | | | | |
|---|---|---|---|---|---|
| 221,258 | A | * | 11/1879 | Walker | 70/25 |
| 229,332 | A | | 6/1880 | Pease | |
| 255,164 | A | * | 3/1882 | Grout | 70/25 |
| 486,666 | A | * | 11/1892 | Deal | 70/25 |
| 596,596 | A | * | 1/1898 | Johnson | 70/25 |
| 1,117,417 | A | * | 11/1914 | Meepos | 70/29 |
| 1,172,970 | A | | 2/1916 | Fowler | |
| 1,571,281 | A | * | 2/1926 | La Port | 70/25 |
| 1,942,454 | A | * | 1/1934 | Samburg | 70/25 |
| 2,647,390 | A | * | 8/1953 | Paulson | 70/227 |
| 3,260,079 | A | * | 7/1966 | Caskey | 70/25 |
| 3,633,388 | A | * | 1/1972 | Atkinson | 70/80 |
| 5,765,409 | A | | 6/1998 | Yang | |
| 5,839,301 | A | * | 11/1998 | Hsu | 70/25 |
| D407,294 | S | | 3/1999 | Chen | |
| 5,901,587 | A | | 5/1999 | Chen | |
| 5,918,489 | A | | 7/1999 | Yang | |
| 5,921,123 | A | | 7/1999 | Schwarzkopf et al. | |
| D426,763 | S | | 6/2000 | Adler et al. | |
| D428,398 | S | | 7/2000 | Coleman | |
| D428,794 | S | | 8/2000 | Fiegener et al. | |
| D439,823 | S | | 4/2001 | Adler et al. | |
| 6,263,758 | B1 | | 7/2001 | Kumamoto et al. | |
| 6,363,758 | B1 | | 4/2002 | Ling | |
| 6,470,718 | B1 | * | 10/2002 | Yang | 70/30 |
| D486,721 | S | | 2/2004 | Ling | |
| 6,955,069 | B2 | * | 10/2005 | Segawa et al. | 70/208 |

(Continued)

OTHER PUBLICATIONS

Notice of Allowance and Fees Due for U.S. Appl. No. 29/367,973; Applicant: Wordlock LLC; Mailing Date: Jan. 19, 2011 (9 pages).

*Primary Examiner* — Lloyd Gall
(74) *Attorney, Agent, or Firm* — Perkins Coie LLP

(57) ABSTRACT

The present disclosure describes combination discus locks and methods for using and making the combination discus lock assembly. The locks include a lock body at least partially containing a locking mechanism coupled to a plurality of engagement members with indicia disposed thereon, capable of displaying a combination. An actuator is coupled to the locking mechanism and to a locking member. The locking member is in a closed position, connected to the body, when the combination is not displayed and in an open position, at least partially disengaged from the lock body, when the combination is displayed. The actuator is manipulated to move the locking member from the closed position to the open position. The lock may also be resettable.

19 Claims, 6 Drawing Sheets

U.S. PATENT DOCUMENTS

| | | | | |
|---|---|---|---|---|
| D513,582 | S | 1/2006 | Osiecki et al. | |
| D524,632 | S | 7/2006 | Kearns et al. | |
| D541,630 | S | 5/2007 | Blomstrom et al. | |
| D542,625 | S | 5/2007 | Blomstrom et al. | |
| 7,222,506 | B2 * | 5/2007 | Yu | 70/21 |
| 7,370,498 | B1 * | 5/2008 | Miao | 70/21 |
| 7,415,850 | B2 * | 8/2008 | Smyczek et al. | 70/51 |
| D638,685 | S * | 5/2011 | Schmidt et al. | D8/334 |
| D649,013 | S * | 11/2011 | Schmidt et al. | D8/334 |
| D662,395 | S * | 6/2012 | Schmidt et al. | D8/334 |
| 2008/0053167 | A1 | 3/2008 | Basche | |
| 2012/0131965 | A1 * | 5/2012 | Schmidt et al. | 70/25 |

* cited by examiner

COMBINATION DISCUS LOCK ASSEMBLY AND METHODS OF USING THE SAME

CROSS-REFERENCE TO RELATED APPLICATIONS

This application claims priority to and the benefit of U.S. Provisional Patent Application No. 61/249,165 filed Oct. 6, 2009 entitled COMBINATION DISCUS LOCK ASSEMBLY AND METHOD OF USING THE SAME, which is incorporated herein by reference in its entirety.

TECHNICAL FIELD

The present invention relates to lock devices and locking methods. In particular, the present invention relates to a combination lock assembly and a locking method using the combination lock assembly.

BACKGROUND

Locks are commonly used for securing a wide variety of objects. For instance, locks are frequently used to secure lockers, toolboxes, luggage, bags, gates, doors, containers, bicycles, vehicles and the like. One main disadvantage of a key-based lock is that a physical key is required to open the lock. A key to a lock may often be misplaced, may be cumbersome to carry, and may be difficult to remember. Another disadvantage of a key-based lock is that a user typically cannot reset or change the key configuration without also replacing the lock.

Conventional discus locks are typically locked and unlocked with a key, and the key is used to move the lock's shackle between open and closed positions. Due to the above mentioned disadvantages, it is desirable to provide a key-less, resettable, combination-style discus lock.

SUMMARY

The present invention provides a discus lock and related methods that overcome drawbacks experienced in the prior art and provide other benefits. Embodiments in accordance with the present disclosure are directed generally toward discus-style combination locks bearing at least one of alphabetic characters, numeric characters, symbols and blanks on a plurality of engagement members.

In at least one embodiment, a combination discus lock having an actuator that can be manipulated by a user to move the lock's locking member, e.g., a shackle, between open and closed positions when the lock's locking device is in an unlocked configuration. The discus lock has one or more engagement members with associated indicia, such as selected letters thereon. The engagement members are coupled to the locking device and can be moved by a user to a selected combination that unlocks the locking device, thereby allowing the actuator to move the locking member between the closed, locked and open, unlocked positions. In one embodiment, the engagement members include a plurality of rotatable wheels adjacent to each other. The wheels each include a plurality of letters thereon, such that the wheels can be rotated and manipulated to align letters to spell one or more words, which can be the combination for the locking mechanism. The wheels can be arranged so the adjacent letters or other indicia are aligned generally transverse to an axis extending between the top and bottom of the lock. Accordingly, when the lock is arranged with the top vertically above the bottom, the letters across the wheels will be arranged generally horizontally.

The discus lock, in at least one embodiment, is resettable so that the combination of the lock may be changed. A reset mechanism can include a manually manipulated reset member, such as an actuator with a slot that allows the user to engage and move (e.g. rotate) the member. The reset member can be moved between a set position wherein the combination is set, and a reset position wherein the combination is not set and a user can change the combination to a different combination before moving the member back to the set position.

In one embodiment, a combination discus lock device is provided that comprises a discus lock housing and a locking mechanism positioned at least partially within the housing. The locking mechanism has a locked position and an unlocked position. A plurality of engagement members are coupled to the locking mechanism and are moveable relative to the housing. The engagement members include indicia thereon and are configurable to display with the indicia a combination to unlock the locking mechanism. When the combination is displayed the locking mechanism is moveable from the locked position to the unlocked position, and when the combination is not displayed the locking mechanism is blocked from moving to the unlocked position. A shackle is connected to the housing and coupled to the locking mechanism. The shackle is moveable relative to the housing between open and closed positions. The shackle is movable to the open position when the locking mechanism is in the unlocked position and when the combination is displayed, and the shackle is retained in the closed position when the locking mechanism is in the locked position. An actuator is coupled to the locking mechanism and to the shackle. A portion of the actuator is exterior of the housing and is manually engageable by a user. The actuator is moveable relative to the housing between first and second positions causing the shackle to move between the closed and open positions. The actuator is free to move from the first position to the second position when the locking mechanism is in the unlocked position, and the actuator being restricted from moving to the second position when the locking mechanism is in the locked position.

In another embodiment, a combination discus lock device comprises a discus lock housing and a locking mechanism positioned at least partially within the housing and having a locked position and an unlocked position. A plurality of engagement members are coupled to the locking mechanism and are moveable relative to the housing. The engagement members including indicia thereon and are configurable to display with the indicia a combination to unlock the locking mechanism. When the combination is displayed the locking mechanism is moveable from the locked position to the unlocked position, and when the combination is not displayed the locking mechanism is blocked from moving to the unlocked position. A shackle is connected to the housing and coupled to the locking mechanism. The shackle is moveable relative to the housing between open and closed positions. The shackle is movable to the open position when the locking mechanism is in the unlocked position and when the combination is displayed. The shackle is retained in the closed position when the locking mechanism is in the locked position. An actuator is coupled to the locking mechanism and to the shackle. A portion of the actuator is exterior of the housing and is manually engageable by a user. The actuator is moveable relative to the housing between first and second positions causing the shackle to move between the closed and open positions. The actuator is free to move from the first position to the second position when the locking mechanism is in the unlocked position. The actuator is restricted from moving to the second position when the locking mechanism is in the locked position.

In yet another embodiment, a combination discus lock device comprises a discus lock body and a locking mechanism positioned at least partially within the lock body. The locking mechanism is movable between a locked configuration and an unlocked configuration. A plurality of wheels are coupled to the locking mechanism and are individually rotatable with respect to the body. The plurality of wheels are positioned coaxially aligned and a plurality of indicia sets corresponding to the plurality of wheels, wherein the wheels are configured to display a combination, and wherein the locking mechanism is moveable from the locked to the unlocked configuration when the combination is displayed. A shackle is coupled to the locking mechanism and is movable relative to the body between an open position and a closed position. A manipulatable lever is connected to the locking mechanism and is manually moveable between first and second positions. The lever is configured to move the shackle from the closed position to the open position when the combination is displayed and when the lever is moved from the first position to the second position.

In another embodiment, a combination discus lock comprises a discus lock body having a front portion, a rear portion opposite the front portion, a recess in the front portion and an aperture in the recess. A locking mechanism is positioned at least partially within the lock body and is movable between a locked configuration and an unlocked configuration. A plurality of wheels are to the locking mechanism and are individually rotatable with respect to the body. The plurality of wheels are positioned coaxially aligned. At least a first portion of the wheels being contained within the housing. A second portion of the wheels protrude through the aperture in the recess in the body. The wheels are manually engageable by a user for rotation of the wheels. A plurality of indicia sets correspond to the plurality of wheels, wherein the wheels are configured to display an unlocking combination, and wherein the locking mechanism is moveable from the locked to the unlocked configuration when the unlocking combination is displayed. A rigid shackle is coupled to the locking mechanism and movable relative to the body between an open position and a closed position. A manipulatable lever is connected to the locking mechanism and is manually moveable between first and second positions. The lever is configured to move the shackle from the closed position to the open position when the unlocking combination is displayed and when the lever is moved from the first position to the second position. A keyless reset mechanism is coupled to the locking mechanism and to the plurality of wheels. The reset mechanism is manually moveable between set and reset positions. When the reset mechanism is in the set position the combination for unlocking the locking mechanism is a first combination. When the reset mechanism is in the reset position the unlocking combination can be changed from the first combination to a second combination different than the first combination.

Another embodiment provides a method of operating a combination discus lock device. The method comprises engaging a combination discus lock device having a lock body. The lock body contains a lock mechanism, and a plurality of wheels coupled to the lock mechanism and configured to display indicia representing an unlocking combination. A shackle is coupled to the lock mechanism, and an actuator is coupled to the lock mechanism. The shackle has an open position and a closed position. In the open position a portion of the shackle is disengaged from the lock body, and in the closed position the portion of the shackle is engaged with the lock body and the locking mechanism prevents the shackle from moving to the open position. The method also includes rotating the plurality of wheels to display the unlocking combination, wherein the unlocking combination is configured to position the wheels relative to the locking mechanism to allow the locking mechanism to move from a locked position to an unlocked position. The method also includes manually moving the actuator from a first position to a second position when the combination is displayed causing the shackle to move from the closed position to the open position.

Yet another embodiment provides a method of making a combination discus lock device. The method comprises providing a discus lock body and a locking mechanism positioned at least partially within the lock body. The locking mechanism has a locked position and an unlocked position. The method includes operably connecting a plurality of engagement members to the locking mechanism. The engagement members are configured to display a combination that allows the locking mechanism to move from the locked position to the unlocked position. The method includes operably coupling an actuator to the locking mechanism, wherein at least a portion of the actuator is exterior of the discus lock body and is moveable relative to the locking mechanism between first and second positions. The method includes operably coupling a shackle to the actuator, and releasably connecting at least a portion of the locking member to the lock body. The locking member has an open position and a closed position. In the closed position the combination is not displayed and the shackle is securely connected to the lock body, and in the open position the combination is displayed and at least a portion of the shackle is disengaged from the lock body. In the unlocked position the actuator is manually manipulatable to move the shackle from the closed position to the open position.

DETAILED DESCRIPTION

The following describes embodiments of combination discus locks and methods of using and manufacturing the locks in accordance with the present disclosure. Embodiments of combination discus locks can include, but are not limited to padlocks, luggage locks, bike locks, and cable locks. Embodiments of the present disclosure can also include different lock shapes including, but not limited to discs, spheres, cylinders, cones, hexahedrons, and any other suitable shape. Embodiments in accordance with the present disclosure are set forth hereinafter to provide a thorough understanding and enabling description of a number of particular embodiments. Numerous specific details of various embodiments are described below with reference to discus-style combination locks having alphabetical characters or symbolic characters, but embodiments can be used with other locks and with other indicia. In some instances, well-known structures or operations are not shown, or are not described in detail to avoid obscuring aspects of this invention. A person skilled in the art will understand, however, that the invention may have additional embodiments, or that the invention may be practiced without one or more of the specific details of the embodiments as shown and described.

FIGS. 1-7 are described below and include numerous details. However, it should be noted that these embodiments are only examples of locks in accordance with the present disclosure. For example, FIGS. 1-7 show engagement members, capable of displaying a combination, as a plurality of wheels 101. However, other types of engagement members capable of displaying a combination may be used in accordance with the disclosed lock device. The actuator is described below as a lever 103, and may also have various embodiments including, but not limited to a switch, a button, and a dial.

Figure 1:
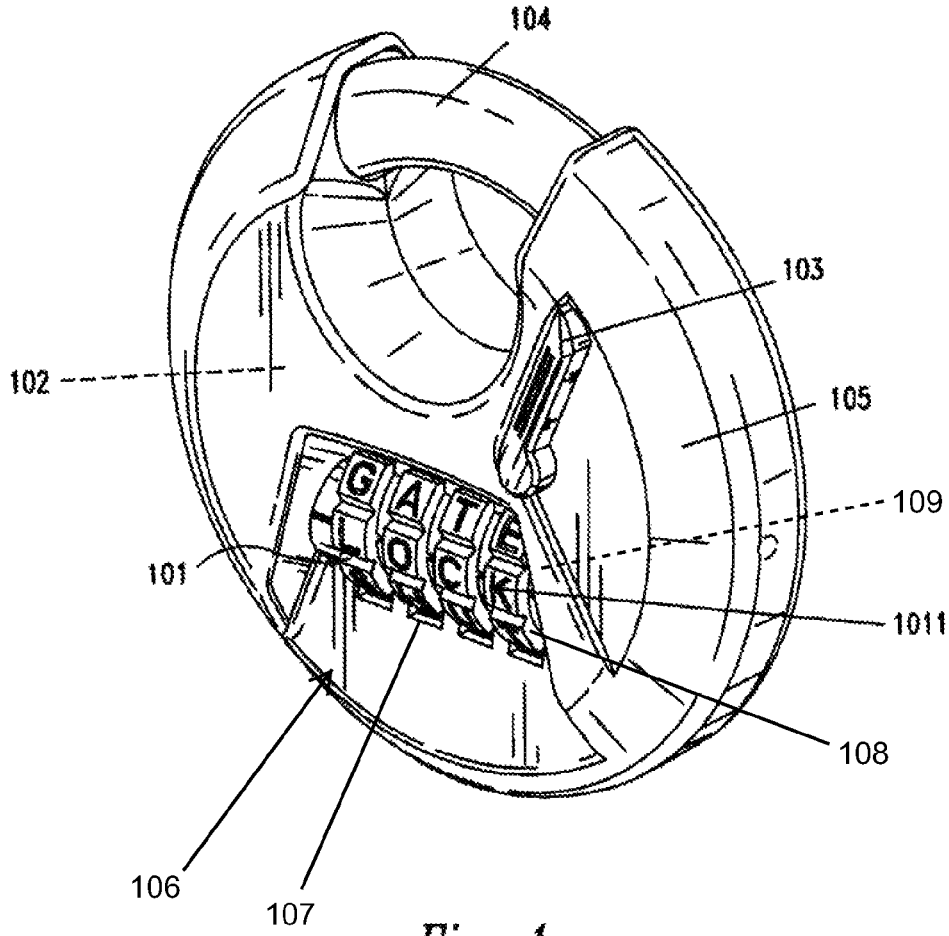
FIG. 1 is a perspective view showing a locked configuration of a combination discus lock in accordance with an embodiment of the present disclosure.
Figure 2:
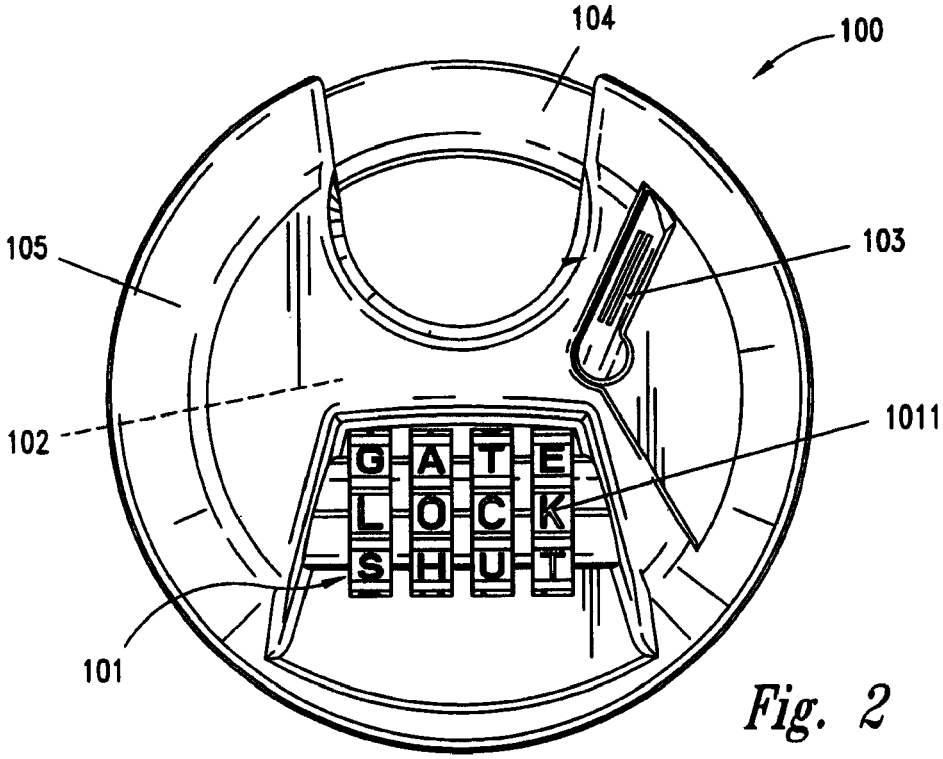
FIG. 2 is a front view showing a locked configuration of the combination discus lock shown in FIG. 1.

FIG. 1 shows an embodiment of a discus lock device 100 including a plurality of wheels 101, a housing 105, a locking mechanism 102 (shown in phantom lines, located within the housing 105), a lever 103, and a shackle 104. The locking mechanism 102 is disclosed in Chinese patent 2010201409997, filed Mar. 25, 2010, and is herein incorporated by reference in its entirety. The wheels 101 each include a plurality of indicia, such as letters 1011, disposed about each wheel 101. In this embodiment, the letters 1011 or other the indicia 1011 on the adjacent wheels 101 are arranged side-by-side so the wheels can be positioned to display a combination with letters. The housing 105 has a recessed area 106 in a front portion of the housing and an aperture 107 in the recessed area 106. The wheels 101 are disposed in the recessed area, wherein the recessed area is sized to allow a user to manually engage and move the wheels relative to the housing. The wheels 101 are coupled to the locking mechanism 102 and are individually rotatable with respect to the housing 105. The wheels 101 of the illustrated embodiment have a first portion 109 contained within the housing, and a second portion 108 of the wheels protrude through the aperture 107 in the recessed area 106. Accordingly, the user can rearrange the wheels to or from the unlocking combination by rotating wheels 101. In this illustrated embodiment, the lock device 100 is shown oriented with the top of the lock vertically disposed above the bottom of the lock, so that the adjacent letters on the wheels 101, which may or may not be the unlocking combination, are displayed generally horizontally, relative to the orientation of the lock device 100. This horizontal orientation of the letters 1011 makes the lock easier to read by the user. However, the wheels 101 may have several other orientations in relation to the locking device, including, but not limited to vertical, diagonal, and staggered. Additionally, the number of wheels 101 may vary depending upon the locking device 100. Greater numbers of wheels 101 create a higher number of possible combinations.

In FIG. 1, the locking mechanism 102, located within the housing 105, is coupled to the wheels 101 and to the lever 103. The lever 103 is further coupled to the shackle 104. In this embodiment, the housing 105 accommodates the locking mechanism 102, a portion of the lever 103, a portion of the wheels 101, and a portion of the shackle 104. However, in other embodiments different portions of the locking mechanism, lever, wheels, and shackle may be contained within the housing. In one embodiment, the locking device 100 is configured so a user can rotate the wheels 101 to align the letters 1011 to correspond to the unlocking combination of the locking device. This arrangement of the wheels positions the locking mechanism in an unlocked position, thereby providing an openable mode (such as the combination of "LOCK" shown in FIG. 1). In this arrangement, the locking mechanism 102 allows the lever 103 to be pivoted, moved, or otherwise activated, thereby moving the shackle 104 from a closed, locked position to an open, unlocked position. Once the wheels are positioned so the combination is not aligned and the locking mechanism is not in the openable mode (such as when the aligned letters are not shown as "LOCK" in FIG. 1), the locking mechanism is in a locked position and the shackle 104 remains closed. The lever 103 may be immobile when the locking mechanism 102 is in the locked position. In a different embodiment, the lever 103 may be manipulatable, but not engage the shackle until the locking mechanism 102 is in the unlocked position.

Figure 3:
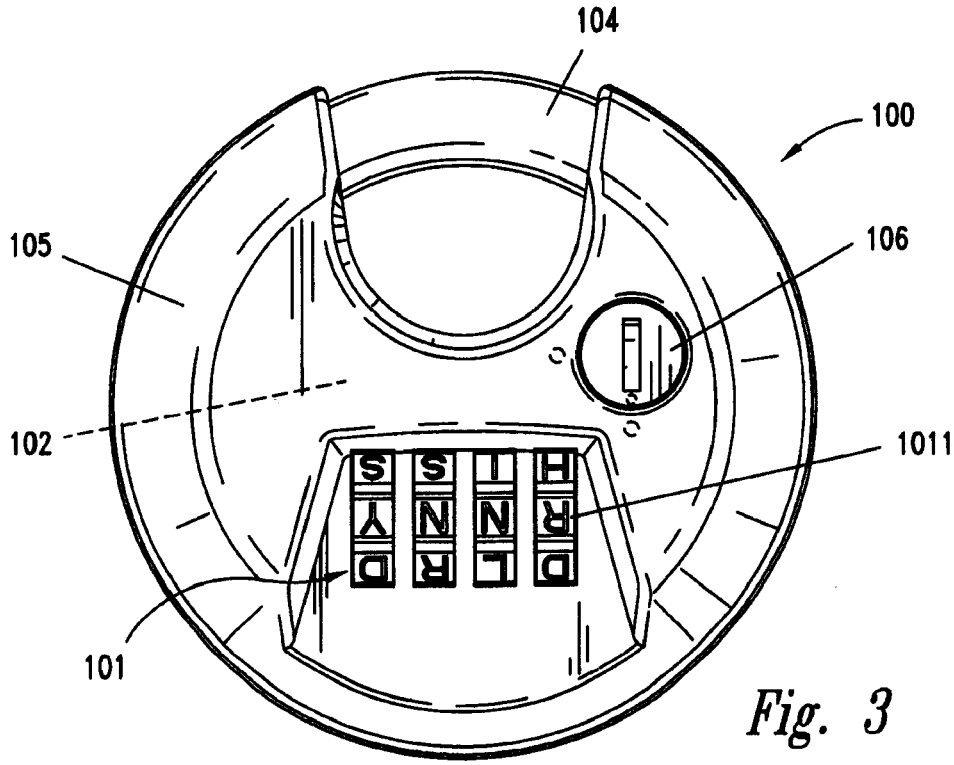
FIG. 3 is a back view showing a locked configuration of the combination discus lock shown in FIG. 1.
Figure 4:
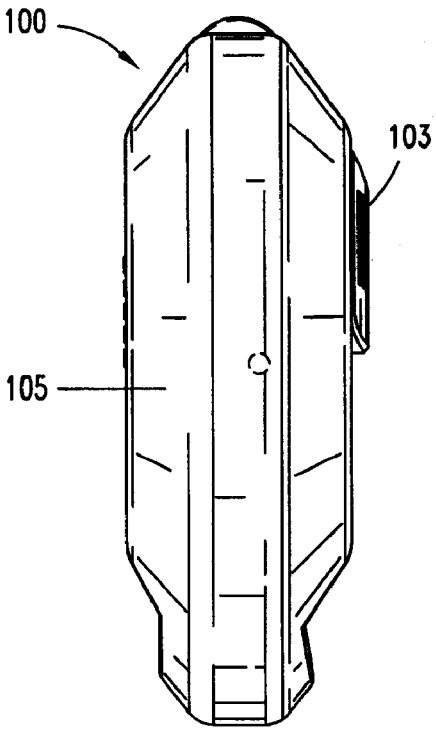
FIG. 4 is a right side view showing a locked configuration of the combination discus lock shown in FIG. 1.
Figure 5:
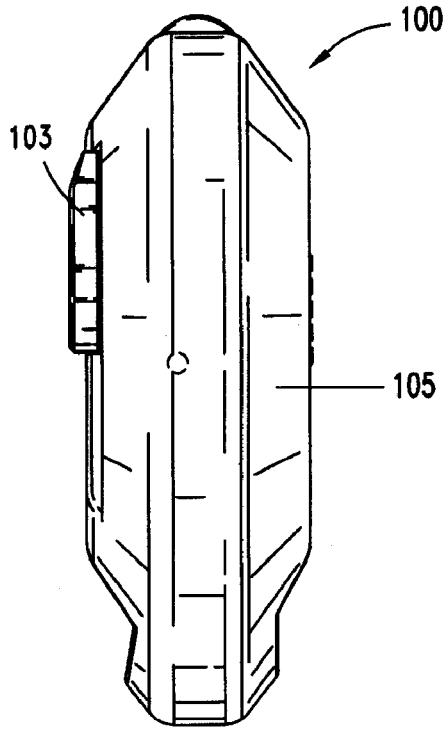
FIG. 5 is a left side view showing a locked configuration of the combination discus lock shown in FIG. 1.
Figure 6:
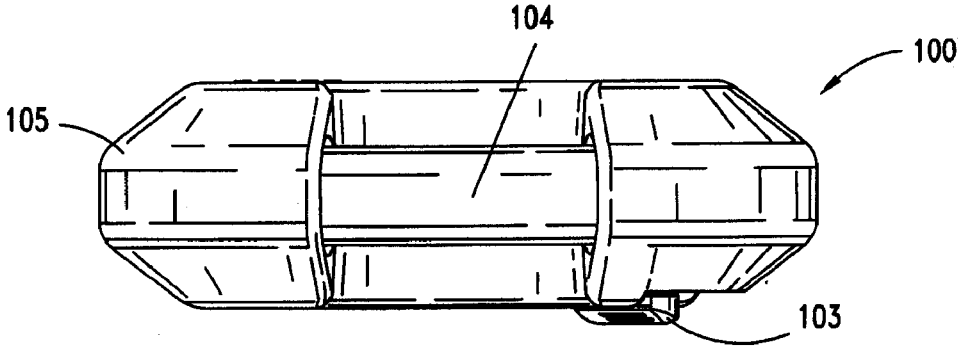
FIG. 6 is a top view showing a locked configuration of the combination discus lock shown in FIG. 1.
Figure 7:
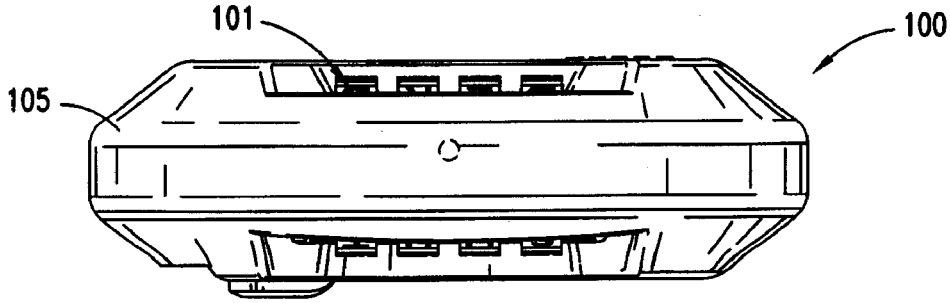
FIG. 7 is a bottom view showing a locked configuration of the combination discus lock shown in FIG. 1.
Figure 8:
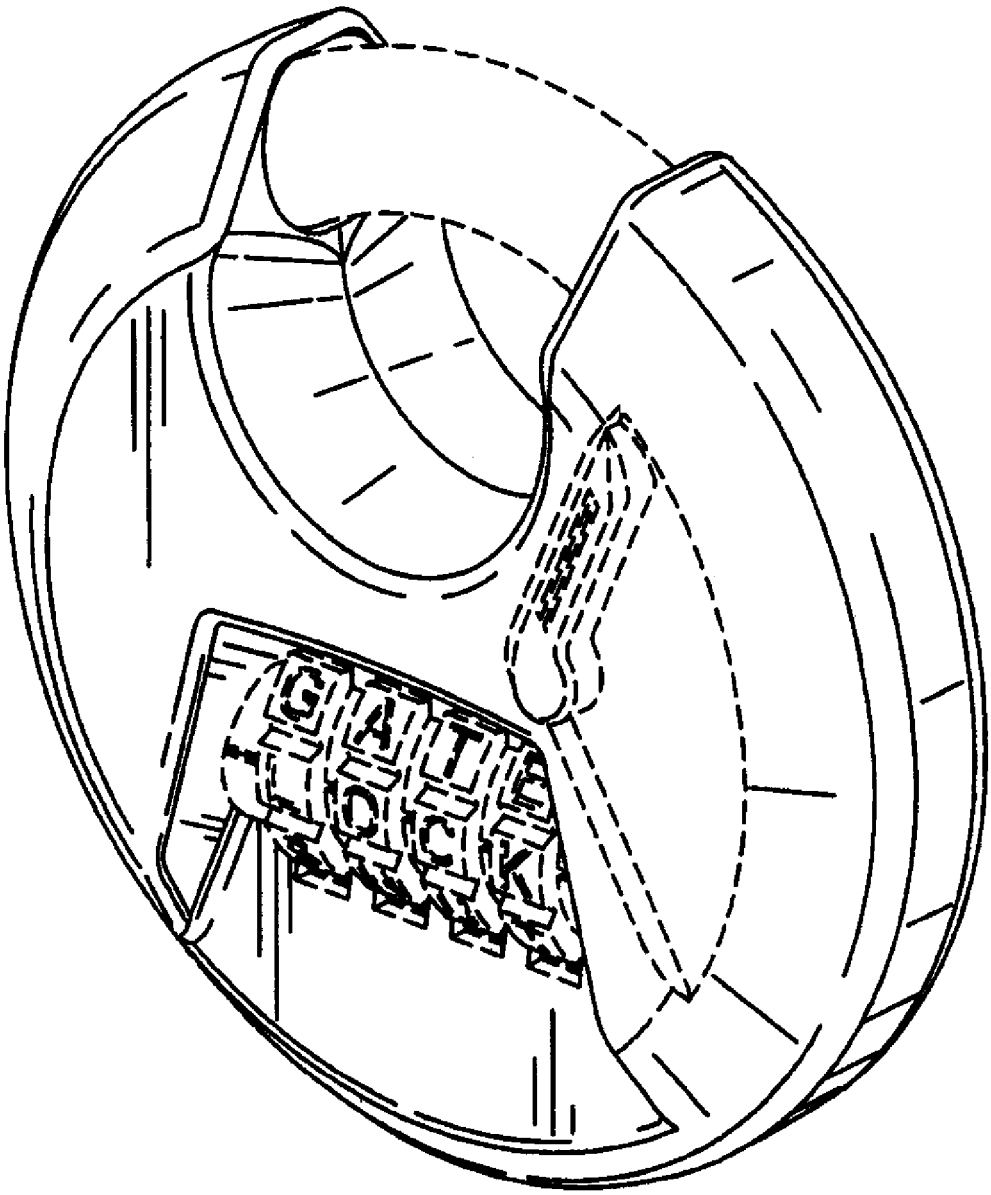
FIGS. 8-14 are views of a design of a combination discus lock in accordance with an embodiment of the present invention.
Figure 9:
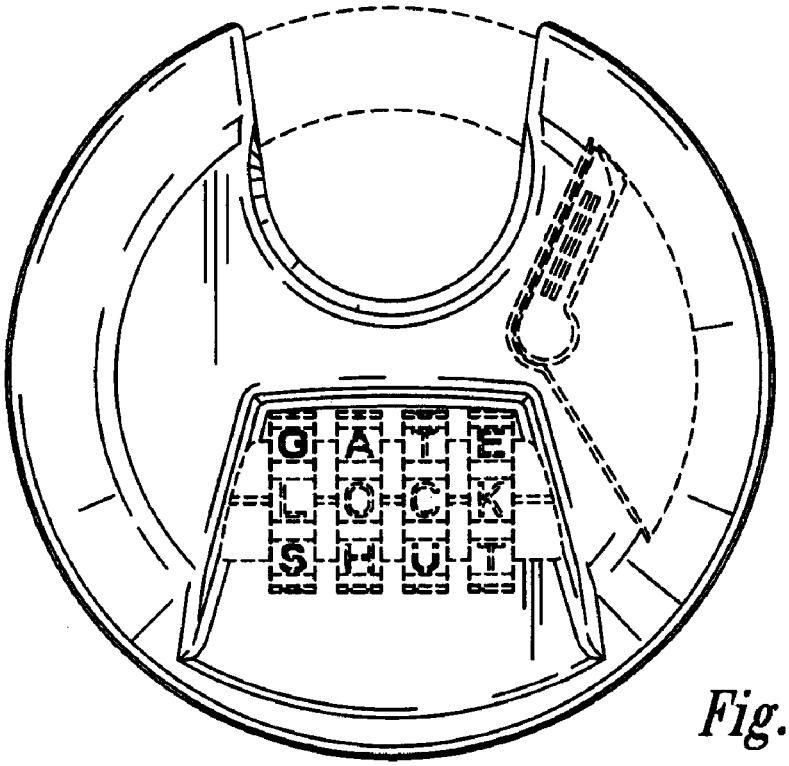
Figure 10:
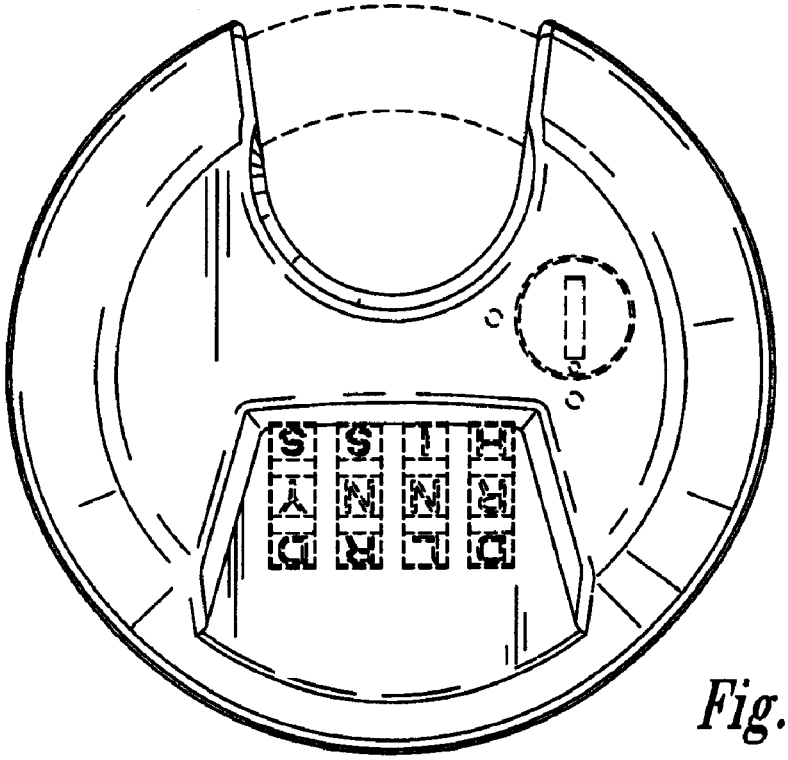
Figure 11:
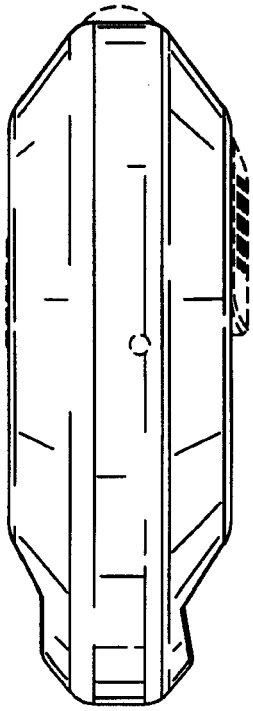
Figure 12:
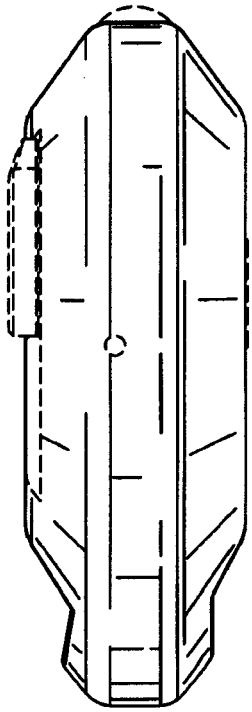
Figure 13:
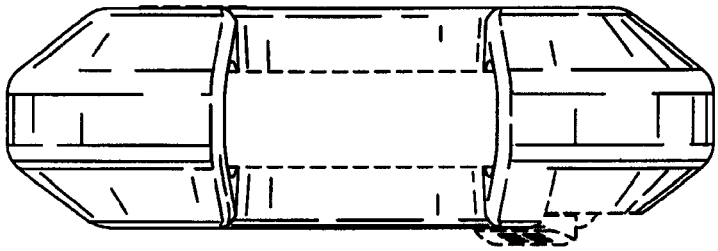
Figure 14:
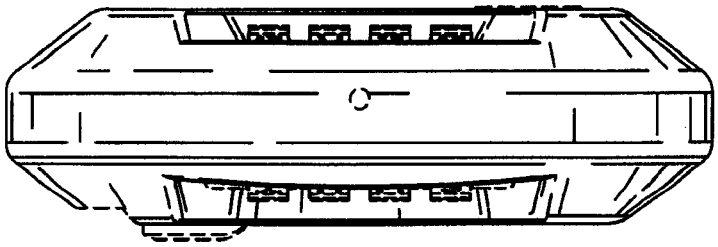

In at least one embodiment, the lock device 100 is resettable, such that a user can change or "re-set" the combination of the locking mechanism 102 that allows the locking mechanism to move from the locked position to the unlocked position. As shown in FIG. 3, the lock device 100 has a reset mechanism 106 coupled to the locking mechanism 102. In the illustrated embodiment, the reset mechanism 106 is accessible from, as an example, the back of the housing. The reset mechanism 106 may be in other locations on the lock device 100, such as the front, side, or bottom. The reset mechanism 106 can be moved by a user between a set and a reset position. In the set position, the combination for the unlocked position of the locking mechanism 102 that was previously selected is fixed. In one embodiment, the reset mechanism 106 can only be moved to the reset position by the user when the combination is displayed on the wheels. In the reset position, the reset mechanism allows the wheels to be moved to a new combination that will unlock the locking mechanism. When the reset mechanism 106 is returned to the set position, the new combination is established and may be used to place the locking mechanism 102 in the unlocked position. FIG. 3 shows the reset mechanism 106 as a rotatable dial. However, the reset mechanism may have various embodiments including, but not limited to, a button, a lever, a switch, or other suitable resetting mechanism. It should also be noted that alternative embodiments may include a reset mechanism that does not require the locking device to display the combination for the reset mechanism to be manipulated to the reset position, e.g., lock and key mechanisms.

From the foregoing, it will be appreciated that specific embodiments of the invention have been described herein for purposes of illustration, but that various modifications may be made without deviating from the invention. Additionally, aspects of the invention described in the context of particular embodiments or examples may be combined or eliminated in other embodiments. Although advantages associated with certain embodiments of the invention have been described in the context of those embodiments, other embodiments may also exhibit such advantages. Additionally, not all embodiments need necessarily exhibit such advantages to fall within the scope of the invention. Accordingly, the invention is not limited except as by the appended claims.

We claim:

1. A combination discus lock device, comprising:

a discus lock housing;

a locking mechanism, positioned at least partially within the housing and having a locked position and an unlocked position;

a plurality of engagement members moveable relative to the housing, the engagement members including indicia thereon and being configurable to display with the indicia a combination to unlock the locking mechanism, when the combination is displayed the locking mechanism is moveable from the locked position to the unlocked position, and when the combination is not displayed the locking mechanism is blocked from moving to the unlocked position, wherein the housing has a recessed area in a front portion of the housing, and the engagement members are disposed in the recessed area, the recessed area being sized to allow a user to manually engage and move the engagement members;

a shackle connected to the housing and being moveable relative to the housing between open and closed positions, the shackle being movable to the open position when the locking mechanism is in the unlocked position and when the combination is displayed, and the shackle being retained in the closed position when the locking mechanism is in the locked position; and an actuator connected to the shackle, a portion of the actuator is exterior of the housing on the front portion adjacent to the engagement members and is manually engageable by a user, the actuator being moveable along a portion of the front portion of the housing between first and second positions causing the shackle to move between the closed and open positions, the actuator being free to move from the first position to the second position when the locking mechanism is in the unlocked position, and the actuator being restricted from moving to the second position when the locking mechanism is in the locked position.

2. The combination discus lock device of claim 1 wherein the engagement members are wheels, each wheel having a plurality of indicia thereon, the indicia comprises a plurality of letters, wherein the wheels configured so the indicia on adjacent wheels combine to display at least one word.

3. The combination discus lock of claim 1 wherein the actuator is a lever moveable by a user relative to the housing and the shackle between the first and second positions.

4. The combination discus lock device of claim 3 wherein a portion of the lever extends into the housing and the lever pivots between the first and second positions about the portion of the lever that extends into the housing.

5. The combination discus lock of claim 1 wherein the actuator is pivotable relative to the housing and to the shackle between the first and second positions, and the actuator is restrained from pivoting to the second position when the locking mechanism is in the locked position.

6. The combination discus lock device of claim 1, further comprising a keyless reset mechanism manually moveable between set and reset positions, when the reset mechanism is in the set position, the combination for unlocking the locking mechanism is a first combination, when the reset mechanism is in the reset position, the combination to unlock the locking mechanism can be changed from the first combination to a second combination different than the first combination.

7. The combination discus lock device of claim 6 wherein the keyless reset mechanism is moveable from the set position to the rest position when the engagement members display the combination and when the locking mechanism is in the unlocked position.

8. The combination discus lock device of claim 7 wherein the keyless reset mechanism is blocked from moving from the set position to the reset position when the locking mechanism is in the locked position.

9. The combination discus lock device of claim 1, further comprising a keyless reset mechanism at least a portion of the keyless reset mechanism being exterior of the housing and manually moveable between a combination set position and a combination reset position.

10. A combination discus lock device comprising:

a discus lock body;

a locking mechanism positioned at least partially within the lock body, the locking mechanism being movable between a locked configuration and an unlocked configuration;

a plurality of wheels each individually rotatable with respect to the body, the plurality of wheels being substantially coaxially aligned;

a plurality of indicia sets corresponding to the plurality of wheels, wherein the wheels are configured to display a combination comprising a pre-selected subset of the indicia, and wherein the locking mechanism is moveable from the locked to the unlocked configuration when the combination is displayed;

a shackle movable relative to the body between an open position and a closed position; and a manipulatable actuator connected to the shackle and being manually moveable relative to the body and the shackle between first and second positions, the actuator moving the shackle from the closed position to the open position when the combination is displayed and when the actuator is moved from the first position to the second position.

11. The combination discus lock device of claim 10 wherein the combination comprises pre-selected indicia aligned on the plurality of wheels.

12. The combination discus lock device of claim 10, further comprising a keyless reset mechanism manually moveable between set and reset positions, when the reset mechanism is in the set position the combination for unlocking the locking mechanism is a first combination, when the reset mechanism is in the reset position the combination to unlock the locking mechanism can be changed from the first combination to a second combination different than the first combination.

13. The combination discus lock device of claim 10 wherein the sets of indicia include at least one of alphabetic letters, numeric characters, symbols, blanks, and shapes.

14. A combination discus lock, comprising:

a discus lock body having a front portion, a rear portion opposite the front portion, a recess in the front portion and a plurality of apertures in the recess;

a locking mechanism positioned at least partially within the body and being movable between a locked configuration and an unlocked configuration;

a plurality of wheels each individually rotatable with respect to the body, the plurality of wheels being coaxially aligned, at least a first portion of the wheels being contained within the body, a second portion of the wheels protruding through the apertures in the recess in the body, the wheels being manually engageable by a user for rotation of the wheels;

a plurality of indicia sets corresponding to the plurality of wheels, wherein the wheels are configured to display a combination, and wherein the locking mechanism is moveable from the locked to the unlocked configuration when the combination is displayed;

a shackle at least partially disposed in the body and being movable relative to the body between an open position and a closed position;

a manipulatable lever disposed on the front portion of the body adjacent to the plurality of wheels, the lever being connected to the shackle and being manually moveable relative to the shackle and along the front portion of the body between first and second positions when the combination is displayed, the lever causes the shackle to move from the closed position to the open position when the combination is displayed and when the lever is moved from the first position to the second position; and a keyless reset mechanism manually moveable between set and reset positions, when the keyless reset mechanism is in the set position the combination for unlocking the locking mechanism is a first combination, when the reset mechanism is in the reset position the combination to unlock the locking mechanism can be changed from the first combination to a second combination different than the first combination.

15. The combination discus lock of claim 14 wherein the sets of indicia include at least one of alphabetic letters, numeric characters, symbols, blanks, and shapes.

16. A method of operating a combination discus lock device, comprising:

engaging a combination discus lock device, the combination discus lock device having a discus-lock body, the body containing a locking mechanism, a plurality of wheels configured to display indicia representing an unlocking combination, a shackle moveable relative to the lock body, and an actuator connected to the shackle, wherein the shackle has an open position and a closed position, in the open position a portion of the shackle is disengaged from the body and in the closed position the portion of the shackle is engaged with the body and the locking mechanism prevents the shackle from moving to the open position;

rotating the plurality of wheels to display the unlocking combination and to position the wheels relative to the locking mechanism to allow the locking mechanism to move from a locked position to an unlocked position; and manually moving the actuator relative to the shackle along a front portion of the body adjacent to the wheels from a first position to a second position when the combination is displayed causing the shackle to move from the closed position to the open position.

17. The method of claim 16, wherein the unlocking combination is a first combination, further comprising:

rotating the plurality of wheels to display the first combination;

manually manipulating a reset device to a reset position, the reset device at least partially contained within the body, wherein the reset device is manipulatable when the wheels display the first combination; the reset device in the reset position being configured to allow the unlocking combination to be changed from the first combination to a second combination;

rotating the plurality of wheels to display the second combination; and manually moving the reset device away from the reset position.

18. A method of making a combination discus lock device comprising:

providing a discus-lock body and a locking mechanism positioned at least partially within the body, the locking mechanism having a locked position and an unlocked position;

operably connecting a plurality of engagement members to the locking mechanism, the engagement members being configured to display a combination that allows the locking mechanism to move from the locked position to the unlocked position;

operably coupling an actuator to the locking mechanism, wherein at least a portion of the actuator is exterior of the body and is moveable relative to the body and the shackle between first and second positions;

operably coupling a shackle to the actuator, wherein movement of the actuator relative to the shackle and along a front portion of the body causes the shackle to move relative to the body; and releasably connecting at least a portion of the locking mechanism to the body, the shackle having an open position and a closed position, in the closed position the combination is not displayed and the shackle is securely connected to the body, in the open position the combination is displayed and at least a portion of the shackle is disengaged from the body, and when the locking mechanism is in the unlocked position the actuator is manually manipulatable relative to the body and the shackle to move the shackle from the closed position to the open position.

19. The method of claim 18, further comprising:

operably coupling a reset mechanism to the locking mechanism, the reset mechanism adjustable to allow a user to change the combination of the lock device.

* * * * *